United States Patent [19]

Abbey

[11] 4,308,835

[45] Jan. 5, 1982

[54] CLOSED-LOOP FLUIDIC CONTROL SYSTEM FOR INTERNAL COMBUSTION ENGINES

[76] Inventor: Harold G. Abbey, 11 Goldsmith Dr., Holmdel, N.J. 07733

[21] Appl. No.: 214,626

[22] Filed: Dec. 10, 1980

Related U.S. Application Data

[60] Continuation-in-part of Ser. No. 115,551, Jan. 25, 1980, Pat. No. 4,250,856, which is a continuation-in-part of Ser. No. 962,883, Nov. 22, 1978, Pat. No. 4,187,805, which is a continuation-in-part of Ser. No. 919,541, Jun. 27, 1978, which is a division of Ser. No. 730,956, Oct. 9, 1976, Pat. No. 4,118,444.

[51] Int. Cl.[3] ..... F02M 9/14

[52] U.S. Cl. ..... 123/439; 251/61.2; 251/61.5; 137/596.18; 261/44 D; 261/DIG. 56; 123/440

[58] Field of Search ..... 261/DIG. 56, 44 D; 123/439, 440; 137/DIG. 8, 596.18; 251/61.2, 61.5

[56] References Cited

U.S. PATENT DOCUMENTS

| | | | |
|---|---|---|---|
| 1,378,055 | 5/1921 | Pusey | 261/DIG. 56 |
| 3,570,824 | 3/1971 | Strohm et al. | 261/DIG. 56 |
| 3,739,797 | 6/1973 | Caldwell | 123/568 |
| 3,818,880 | 6/1974 | Dawson et al. | 123/568 |
| 3,861,642 | 1/1975 | Maddocks | 123/568 |
| 3,974,813 | 8/1976 | Knapp et al. | 123/439 |
| 4,021,513 | 5/1977 | Ullman | 261/DIG. 56 |
| 4,089,311 | 5/1978 | Brettschneider et al. | 123/439 |
| 4,102,313 | 7/1978 | Laprade et al. | 123/440 |
| 4,118,444 | 10/1978 | Abbey | 261/50 A |
| 4,211,196 | 7/1980 | d'Orsay | 261/DIG. 56 |

*Primary Examiner*—Tim R. Miles
*Attorney, Agent, or Firm*—Michael Ebert

[57] ABSTRACT

A closed-loop fluidic control servo system for a vehicle having an internal combustion engine provided with a variable Venturi carburetor having an axially-shiftable spool operated by a vacuum motor. The system acts automatically through the motor to maintain the ratio of fuel-to-air supplied by the Venturi carburetor to the intake manifold of the system at the optimum value during all prevailing conditions of engine speed and load encountered in vehicular operation. The system includes a vacuum amplifier coupled to the intake manifold and responsive to a differential vacuum signal developed between the pressures existing at the inlet and throat of the Venturi to produce a proportionally amplified vacuum which is derived from the intake manifold vacuum and is a function of the vacuum signal. The proportionally amplified vacuum serves to energize the vacuum motor to shift the axial position thereof in a direction and to an extent bringing about the desired fuel-to-air ratio.

15 Claims, 2 Drawing Figures

CLOSED-LOOP FLUIDIC CONTROL SYSTEM FOR INTERNAL COMBUSTION ENGINES

RELATED APPLICATION

Figure 1:
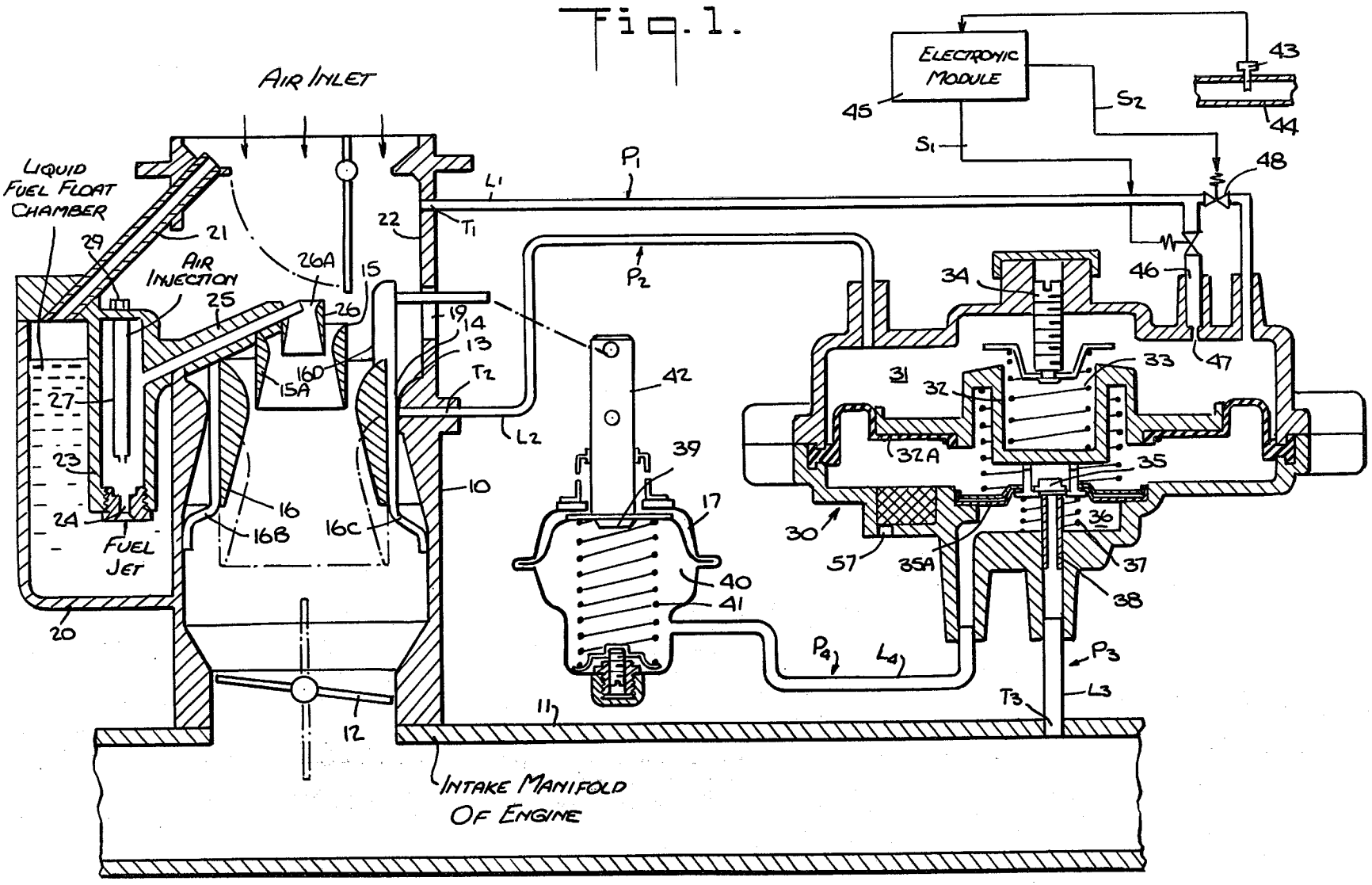

This application is a continuation-in-part of my copending application Ser. No. 115,551, filed Jan. 25, 1980, (now U.S. Pat. No. 4,250,856) entitled "Fuel-Air Ratio Automatic Control System Using Variable Venturi Structure", which in turn is a continuation-in-part of application Ser. No. 962,883, filed Nov. 22, 1978, (now U.S. Pat. No. 4,187,805), which in turn is a continuation-in-part of application Ser. No. 919,541, filed June 27, 1978, which in turn is a division of application Ser. No. 730,956, filed Oct. 9, 1976 (now U.S. Pat. No. 4,118,444).

BACKGROUND OF INVENTION

This invention relates generally to variable Venturi carburetion systems for supplying a fuel-air mixture to the internal combustion engine of an automotive vehicle, and more particularly to a closed-loop fluidic control servo system for automatically regulating the flow of fuel and air admitted into a variable Venturi structure to maintain a desired ratio thereof under varying conditions of load and speed in order to attain higher combustion efficiency, significantly increased fuel economy and reduced emission of pollutants.

The function of a carburetor is to produce the fuel-air mixture needed for the operation of an internal combustion engine. In the carburetor, the fuel is introduced in the form of tiny droplets in a stream of air, the droplets being vaporized as a result of heat absorption in a reduced pressure zone on the way to the combustion chamber whereby the mixture is rendered inflammable. In a conventional carburetor, air flows into the carburetor through a Venturi tube and a fuel nozzle within a booster Venturi concentric with the main Venturi tube. The reduction in pressure at the Venturi throat causes fuel to flow from a float chamber in which the fuel is stored through a fuel jet into the air stream. The fuel is atomized because of the difference between air and fuel velocities.

The fixed sizes of these Venturi's are usually determined by the midrange capacity of the engine. This results in little carburetion action at low capacities for idle and slow speeds so that the carburetion effect is operative only from medium through high speeds. It is for this reason that fuel efficiency is poor at low speeds and the maintenance of the fuel-to-air ratio at all speeds represents a compromise dictated by these limitations.

Another popular carburetor uses manifold vacuum to operate an air-flow cylindrical valve coupled to a tapered needle fuel valve which is controlled by intake manifold vacuum, fuel being introduced eccentrically into a non-circular, non-Venturi passage.

The behavior of an internal combustion engine in terms of operating efficiency, fuel economy and emission of pollutants is directly affected both by the fuel-air ratio of the combustible charge and the degree to which the fuel is vaporized and dispersed in air. Under ideal circumstances, the engine should at all times burn 14.7 parts of air to one part of fuel within close limits, this being the stoichiometric ratio. But in the actual operation of conventional systems, this ratio varies as a function of operating speed and is affected by changes in load and temperature.

To obtain maximum fuel economy, the fuel-to-air ratio in the mixture should be maintained within close tolerances at or about the stoichiometric air-fuel ratio during all modes of operation, such as "idle" while standing still, "slow-speeds" up to about 20 miles an hour, "cruising speeds" and "high speeds." The conventional practice is to provide an accelerating pump system to furnish an extra charge of fuel for accelerations, and power jets or auxiliary barrels for high speed or high power operation, all in addition to the main jet.

Another reason why the maintenance of predetermined fuel-air ratios at or about stoichiometric is important is that the emission of pollutants as well as the power-producing efficiency are in large measure governed thereby. Thus, when the mixture is relatively low in air, carbon monoxide is produced; while when the ratio is excessively rich in fuel, unburned hydrocarbons are emitted in the exhaust.

In modern engine design, the air-fuel ratio in some instances is controlled to maintain a prescribed ratio, or the control system is preprogrammed to accommodate the ratio to specific ranges of speed and load, so that the ratio, for example, is richer at slow speeds and leaner at higher speeds.

The use of an electronic closed-loop engine control system for improving fuel economy and reducing hydrocarbon, $NO_3$ and carbon monoxide exhaust emissions is known. Thus Niepoth et al. of General Motors, in an article entitled "Closed Loop Engine Control" that appeared in the November 1977 issue of the IEEE *Spectrum*, disclose a system employing an exhaust gas or "Lambda" sensor in the form of a platinum-coated zirconium element placed directly in the engine exhaust gas stream.

Upon being heated to its operating temperature by the hot exhaust gases, the Lambda sensor acts as an electrochemical cell which generates a voltage as a function of the air-fuel mixture. When this mixture is leaner than stoichiometric, the sensor output voltage is low, the voltage rising in magnitude as the mixture passes through stoichiometric and becomes richer. The signal information yielded by the exhaust sensor is applied to an electronic control unit that processes this information and converts it into a corresponding vacuum signal in a vacuum modulator. A carburetor receives the vacuum signal from the modulator and controls the ratio of fuel-to-air fed to the engine accordingly.

In the General Motors closed loop system, a vacuum regulator at one end of the modulator maintains vacuum at about 6 inches mercury. At the other end is an on-off valve which supplies clean air into the control vacuum port in its "off" position (zero inch Hg vacuum), and which in its "on" position couples the regulated vacuum to this port. By rapid solenoid switching and control of the relative "on" and "off" periods, pulse width modulation of the vacuum is effected. This serves in the carburetor to control the fuel or air in the mixture by means of a vacuum-operated needle-type fuel valve and a vacuum-operated air bleed valve. The engine receives the air-fuel mixture from the carburetor through the intake manifold, the engine burning the mixture and discharging it down the exhaust manifold past the exhaust gas sensor, thereby closing the loop.

A closed loop system of the General Motors type suffers from distinct limitations, for it fails to take into account certain factors essential to efficient carburetion. It is, of course, desirable to correctly proportion the amount of fuel-to-air in the mixture to be burned in order to fully utilize the fuel. But if the fuel in the correctly proportioned mixture assumes the form of large droplets and is not adequately vaporized before being admitted into the engine, full combustion will not result and the exhaust will include unburned hydrocarbons and carbon monoxide which must be cleaned up in exhaust gas treatment apparatus such as air pumps and converters.

It is vital, therefore, that the carburetor function to fully atomize and disperse the fuel to supply a homogenized, uniformly distributed vaporized mixture into the intake manifold of the engine; for only in this way will the engine operate with optimum fuel economy and with minimal exhaust pollutants.

In the General Motors closed loop carburetor engine system and in the Bosch, Lucas and other fuel injection systems, wherein the operation of a carburetor or fuel injector is pulsemodulated in order to attain the desired fuel-to-air ratio, the inherently intermittent action required by this system lends itself to electronic control. But an intermittent action is incompatible with hydrodynamic gasifying requirements and gives rise to poor fuel atomization and dispersion, so that a properly gasified mixture is not yielded thereby.

In the above-identified copending application of which the present case is a continuation-in-part, there is disclosed a closed-loop engine control system which maintains that ratio of air-to-fuel which represents the optimum ratio for the prevailing condition of engine speed and load. The system includes a variable-Venturi carburetor which acts to properly atomize and disperse the fuel in the air whereby the system not only brings about a marked improvement in fuel economy but also substantially reduces the emission of noxious pollutants. The disclosure of this copending application and the still earlier patent applications related thereto are incorporated herein by reference.

In the system disclosed in my copending application, the variable Venturi structure is constituted by a cylindrical casing and a cylindrical booster coaxially disposed therein whose internal surface has a Venturi configuration to define a primary passage. Interposed between the booster and a section of the casing wall having an external Venturi configuration is an axially-shiftable spool whose internal surface has a Venturi configuration to define between this surface and the spool a variable secondary passage whose throat size depends on the axial position of the spool. A tertiary passage is defined between the outer surface of the spool and the casing section. Air passing through the casing flows through all three passages.

An air-fuel dispersion is fed by a nozzle into the primary passage to intermingle with the air flowing therethrough to form an atomized mixture which is fed into the second passage to intermingle with the air flowing through the throat thereof, from which secondary passage the mixture is fed into the intake manifold of the engine.

The differential air pressure developed between the inlet of the Venturi structure and the throat of the tertiary passage therein is sensed to produce an air-velocity command signal which is applied to a control module that governs a servo motor operatively coupled to the spool to axially shift the spool and thereby adjust the throat of the secondary passage. The intake manifold vacuum which varies as a function of load and speed conditions is sensed to produce a speed-load signal for modulating the command signal in the control module in a manner maintaining an optimum air-fuel ratio under the varying conditions of load and speed.

The air velocity command sensor and the intake manifold vacuum sensor are provided with operating characteristics that are predetermined for an engine of specified size and its load. Thus the signals from the sensors are "pre-programmed" for the responses desired in the operating modes of the engine. The control module, in essence, is an analog computer that not only responds to the command and speed-load signals to effect one-line control of the air-fuel ratio as pre-programmed, but it also accepts auxiliary signals for presetting and adjusting the control to take into account ambient and exhaust conditions. These auxiliary signals are derived from ambient and exhaust sensors which afford continuous control of these variables in real-time.

The velocity of air flowing through the Venturi structure is governed as a function of air volume by a closed process control loop whose air velocity command signal is modulated by a speed-load signal reflecting the degree of intake manifold vacuum developed under the prevailing conditions of speed and load. Thus the air velocity pressure through the Venturi structure is controlled as a function of air-volume and the velocity-pressure controls fuel volume, thereby providing a controlled fuel-air ratio during all changes in air flow as determined by throttle position and engine response. In this way, the "fuel loop" is directly controlled by the "air loop" and the flow of air and fuel in the structure are correlated to cope with transitions through the various modes of vehicle operation smoothly and without hesitation within the prescribed desirable ratios. The emission of pollutants are then held at a low level regardless of the mode of operation .

The system disclosed in my copending application includes at least two transducers: one acting to convert the pressure differential existing between the inlet and throat of the variable Venturi into a command signal proportional thereto; the second acting to convert intake manifold negative pressure into a speed-load signal. These two transducers, in combination with the electronic circuit module and the servo-motor operated thereby to vary the axial position of the spool in the variable Venturi carburetor, constitute the main components of a closed loop electronic control system operating, in real time, to maintain the appropriate air-to-fuel ratio for all operating phases of the engine and the load imposed thereon.

The effectiveness and reliability of this electronic control system obviously depends on the accuracy and durability of the electronic and electrical components included therein. In this age of sophisticated technology, there is a tendency to regard the replacement of a pneumatically or mechanically operated system with an electronic equivalent as a technical advance, and in many instances this view is justified.

However, in the real world of internal combustion engines, personnel trained to operate, maintain and repair such engines are generally not qualified to copy with electronic systems. Though a conventional internal combustion engine which breaks down in the field can often be repaired with simple tools, where the engine includes an electronic control system and the breakdown is due to defective transducers or a disabled electronic module or microprocessor, there is usually little that can be done in the field to overcome this problem.

Moreover, an electronic control system in the environment of an internal combustion engine is subjected to temperature extremes, vigorous vibrations and mechanical shocks, fumes, oil and other conditions for which typical electronic components are not prepared. These conditions create maintenance problems and often shorten the effective life of an electronic system.

SUMMARY OF INVENTION

In view of the foregoing, the main object of this invention is to provide an automatically-controlled, closed-loop fluidic servo system for an internal combustion engine having a variable Venturi carburetor, the system maintaining a stoichiometric or other ratio of air-to-fuel that represents the optimum ratio for a particular engine-load combination to effect a marked improvement in fuel economy and to substantially reduce the emission of noxious pollutants without the need to incorporate a Lambda sensor and an electronic control system responsive thereto.

A significant advantage of the present invention as distinguished from the closed-loop electronic control system disclosed in my copending application is that it altogether eliminates the two external transducers and the electronic controller entailed thereby, the functions of sensing, translation and feedback to control the servo motor governing the operation of the variable-Venturi carburetor being carried out by a durable and reliable fluidic control system which functions efficiently in the environment of the engine.

More particularly, an object of this invention is to provide a closed-loop fluidic control system for an internal combustion engine which includes a vacuum amplifier powered only by intake manifold vacuum and responsive to the pressure differential developed between the input and throat of the variable-Venturi carburetor to produce a proportionally amplified vacuum reflecting these variables for energizing a spring-return, bi-directional vacuum motor for adjusting the axial position of the spool in the Venturi carburetor to attain the desired fuel-to-air ratio.

A salient feature of the present invention resides in the fact that all power for operating the components of the closed-loop fluidic system is derived from the engine intake manifold vacuum, no electrical components or external power sources being entailed for this purpose.

Also an object of the invention is to provide a closed-loop fluidic system which makes use of relatively simple and durable mechanical components which can be maintained and readily repaired or replaced, if necessary, both in the shop and in the field by personnel of ordinary mechanical skills.

While a basic fluidic system in accordance with the invention is entirely mechanical in nature, it may optionally be associated through suitable solenoid-operated fluid control valves with an electronic system responsive to an exhaust or Lambda sensor to provide on-line corrections in the fluidic control system for deviations in air-fuel ratio from stoichiometric.

Yet another object of this invention is to provide a closed-loop fluidic control system which maintains the optimum ratio of fuel-to-air under varying conditions of engine speed and load, and under different operating modes, which system lends itself to low-cost mass production. Because of its uncomplicated mechanical nature, one can, without difficulty, retrofit an existing engine with a fluidic closed-loop control system in accordance with the invention and thereby upgrade the efficiency of the engine in terms of fuel economy and reduced noxious exhaust emissions.

Briefly stated, these objects are attained in a closed-loop fluidic control system for an internal combustion engine having a variable-Venturi carburetor, the system automatically adjusting the position of the axially-shiftable spool of the Venturi so as to closely control the ratio of fuel-to-air supplied by the carburetor to the intake manifold of the engine and during all prevailing conditions of engine speed, load and operating modes.

The system includes a vacuum amplifier constituted by a vacuum-regulating valve in a vacuum chamber coupled to the intake manifold of the engine and controlled by a diaphragm and spring assembly which responds in a low pressure chamber to the pressure differential vacuum signal developed between the input and throat of the Venturi, the vacuum chamber yielding a strong vacuum directly proportional to the Venturi pressure differential signal. This amplified vacuum is applied to a bi-directional, spring-return vacuum motor operatively coupled to the Venturi spool which acts to axially shift the spool in a direction and to an extent bringing about the desired ratio of air-to-fuel, either by proportioning the fuel flow by the direct effect of the Venturi pressure differential vacuum acting on the fuel, or by regulating according to the Venturi pressure differential the fuel fed to a nozzle or injector in those applications where a pressurized fuel feed is desirable.

To correct for deviations from stoichiometric produced by the fluidic closed-loop control system in the air-fuel ratio, an air-fuel ratio sensor placed in the engine exhaust is provided. The sensor voltage is processed by an electronic module which generates a first control voltage when the sensed deviation indicates excessive fuel, the first control voltage operating a normally-open first valve interposed in the line between the Venturi inlet and the vacuum signal chamber of the amplifier to effect opening of the Venturi to an extent providing the required leaning to restore stoichiometric. When the sensed deviation indicates insufficient fuel, the module de-energizes the first valve and generates a second control voltage which is applied to a normally-closed second valve in a by-pass line of the fixed orifice between the Venturi inlet and the vacuum signal chamber of the amplifier, causing a reduction of the air flow signal to an extent enriching the fuel to restore stoichiometric.

OUTLINE OF DRAWINGS

Figure 2:
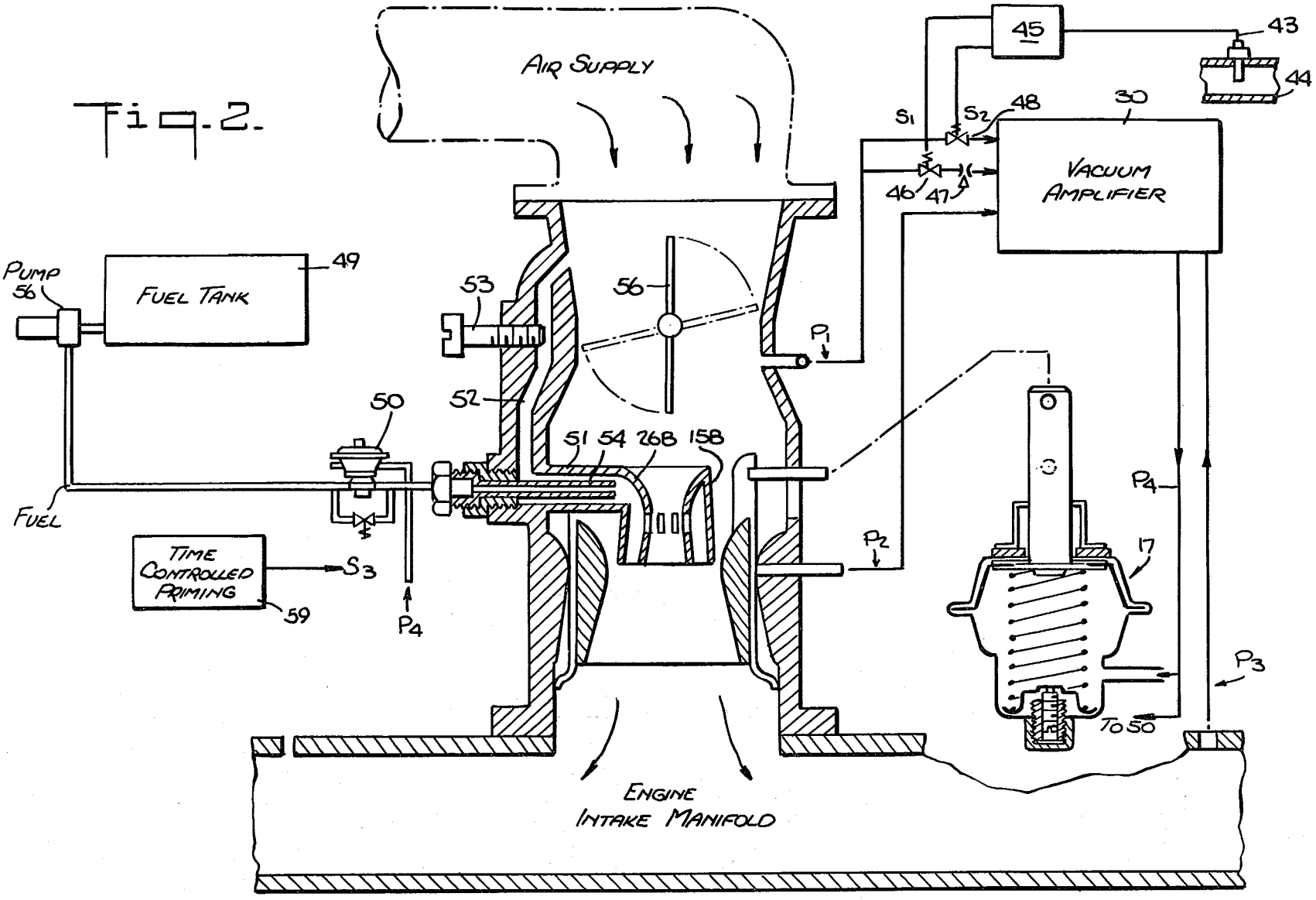

For a better understanding of the invention as well as other objects and further features thereof, reference is made to the following detailed description to be read in conjunction with the accompanying drawings, wherein:

FIG. 1 schematically illustrates a closed loop fluidic control servo system for an internal combustion engine having an inductive fuel feed arrangement; and FIG. 2 schematically illustrates a control system in accordance with the invention having a pressurized fuel feed arrangement.

DESCRIPTION OF INVENTION

General Introduction

In an automobile powered by an internal combustion engine, the engine speed, the air valve or throttle position and the intake manifold pressure are the determinants for the operating conditions of the engine when it is warm. These characteristic determinants are interrelated, the fuel requirements of the engine being governed by the instantaneous state thereof. In order, therefore, to optimize the combustion efficiency of the engine, the present invention provides a self-regulating, closed-loop fluidic control system which governs the air-fuel ratio in real time, the system being rapidly responsive to changes in engine speed and load whereby transitions are smooth and bumpless.

By combustion efficiency is meant power economy expressed in miles per gallon and complete combustion of the available fuel to minimize the emission of unburned hydrocarbons and carbon monoxide. For purposes of combustion efficiency, not only is it necessary to accurately proportion the amount of fuel to air in the mixture to satisfy existing engine conditions, but the air and fuel must be thoroughly intermingled, atomized and vaporized to a gas-like consistency. Failure to accomplish this objective results in incomplete combustion, as a consequence of which carbon monoxide and hydrocarbons are exhausted from the engine with an attendant loss of combustion efficiency.

In a closed loop fluidic control system in accordance with the invention, control of the air-fuel ratio is effected in a multi-passage variable-Venturi structure operating in conjunction with the system in an arrangement wherein the fuel is either induced into the Venturi primary passage or is supplied thereto under pressure. The term "pressure feed" is used rather than conventional fuel injection; for in the present invention, carburetion and injection take place concurrently, so that the pressure feed arrangement represents a hybrid of induction and injection.

In a system in accordance with the invention, whether of the inductive or pressure feed type, before being admitted into the Venturi, the fuel is first partially dispersed by means of an air tube which induces air into the fuel being fed into the primary passage, the mixture being rendered turbulent and less dense, further mixing with combustion air in the secondary passage in a low-pressure, high velocity environment to vaporize the fuel in air, the secondary passage having a variable throat.

In a system in accordance with the invention, the differential pressure $P_1-P_2$ signal developed between the air inlet to the Venturi structure and the throat of the tertiary passage is sensed in a vacuum amplifier which produces a proportional amplified vacuum that is applied to a vacuum motor acting to adjust the Venturi throat in the secondary passage to provide the velocity-pressure controlling the quantity of fuel volume in the mixture to produce an air-fuel ratio appropriate to the prevailing conditions of speed and load. The vacuum amplifier is coupled to the intake manifold of the engine, and is controlled by a balanced diaphragm and valve assembly responsive to the Venturi pressure differential signal to produce a strong vacuum that derives from the existing manifold vacuum and is a function of the differential air-flow pressure.

In the inductive feed arrangement, the differential pressure signal is the controlling force which determines the volume of fuel entering the air stream via a nozzle feeding the primary passage of the Venturi structure. In the pressure feed arrangement, the vacuum signal is applied to a vacuum flow regulator that controls the pressurized feed of the fuel dispersion into the Venturi primary passage.

The term "Venturi Structure," as used herein, refers to a structure invented by Venturi to measure the flow of fluids and gases by means of a tube whose inlet or entry section converges toward a constricted throat section which in turn leads to a diverging outlet section, all sections having a circular cross section. In the present invention, an upstream tap in the Venturi structure makes available the input static pressure ($P_1$), while a tap at the throat provides a static pressure ($P_2$), which is less than that at the upstream tap, such that the differential pressure ($P_1-P_2$) is a function of the velocity of air passing through the structure, and is a measure, therefore, of the instantaneous volume.

In order to obtain an accurate indication of air flow velocity, it is important in the variable Venturi that a circular cross section thereof be maintained at all adjusted positions of the structure, and that the static pressure tap ($P_2$) at the throat is taken from a passage containing no fuel and constitutes an air envelope surrounding the air-fuel mixture.

First Embodiment

While a system in accordance with the invention is operable with any of the variable-Venturi structures disclosed in my above-identified earlier filed copending patent applications, use is preferably made of a three-stage variable-Venturi structure of the type shown in FIG. 1 having a tubular casing 10 into which an air stream at atmospheric pressure is introduced. The lower end of casing 10 is coupled to the intake manifold 11 of the internal combustion engine through a foot-operated throttle inlet 12.

Disposed in the mid-section of casing 10 is a stationary ring 13 having an external Venturi configuration which defines a Venturi throat 14. Mounted coaxially within casing 10 is a cylindrical booster 15 having an internal Venturi configuration to define a primary passage 15A. The Venturi structure is completed by an axially-shifted cylindrical spool 16 interposed between booster 15 and ring 13 whose outer surface is a true cylinder and whose inner surface forms with the outer surface of booster 15 a secondary Venturi passage 16A whose inlet has a parabolic formation leading to a constricted throat. While the inlet section or entry of spool 16 may have a straight tapered formation, the value of a parabolic surface lies in the linear change in cross-sectional area that occurs with linear axial movement of spool 16 as it is manipulated by a bi-directional vacuum motor 17.

The exterior surface of spool 16, while having a uniform cylindrical form, defines an annular tertiary Venturi passage 14 in conjunction with casing ring 13 which has a constant cross section in all axial positions of spool 16 to provide an ideal air metering means.

Thus while the size of the throat 14, **15*a* and 16*a* is constant, the interior shape and position of spool 16 determines the air velocity vs. cross-sectional area characteristics of the multiple Venturis defined by the exterior surface of spool 16, Venturi ring 13, the interior surface of spool 16, the exterior surface of booster 15, the interior surface of booster 15, the exterior of fuel nozzle 26, and the interior surface of nozzle 26. In practice, instead of a straight exterior surface, spool 16 may be tapered to provide a rising characteristic. Alternatively, the total cross-sectional area of the through air passages constituting the "main" throat for any position of spool 16 consists of annular space 14 plus annular space 16A and annular spaces 15A and 26*a***.

To improve the volumetric efficiency of the Venturi structure by avoiding linkage mechanisms for the spool which project into the flow passage, the outer surface of spool 16 is provided at diametrically-opposed positions with a pair of guides 16B and 16C which are slidably received in Venturi ring 13 and the interior of tubular casing 10. Guide 16C is provided with an extension 16D and a pin 18 which projects through a slot 19 in casing 10, pin 18 being operatively coupled to vacuum motor 17 so that spool 16 may be axially raised or lowered within the limits defined by the slot. Because slot 19 in casing 10 which accommodates projecting pin 18 is on the inlet side of the Venturi, it requires no seal against air entry.

Adjacent casing 10 is a liquid fuel float chamber or reservoir 20, the upper end of which is vented through a duct 21 leading from the air inlet 22 of the Venturi structure. Fuel is drawn by induction from chamber 20 through a vertical tube 23 having a fuel jet orifice 24 at its lower end, the upper end of tube 23 communicating through a connecting duct 25 terminating in a Venturi nozzle 26 which is supported by the duct coaxially within booster 15 of the Venturi structure.

Air for dispersing the fuel is introduced into fuel tube 23 by way of an air induction tube 27, whose inlet terminates in the fuel tube below the normal fuel level. Inlet 29 of the air tube communicates with the air inlet 22 of the Venturi structure. The Venturi air differential pressure ($P_1-P_2$) acts on the fuel nozzle 26 and its connecting passage 25 to fuel tube 23 to draw fuel through jet-orifice 24 and air through tube 27.

Thus air is injected into the fuel before the fuel is fed into the carburetor. The injected air brings about a liquid fuel dispersion which promotes vaporization and reduces the fuel density, which in turn facilitates control of fuel "lag." The air/fuel dispersion is proportioned and maintained by the fixed orifices of fuel and air tubes, the quantity of dispersion induced into the primary passage being proportional to the prevailing pressure differential of air input pressure ($P_1$) less Venturi throat pressure ($P_2$), less the liquid fuel head in fuel tube 23 above openings in tube 23.

Essential to a fluidic control system in accordance with the present invention are three pressure variables; namely, the pressure $P_1$ picked up at tap $T_1$ communicating with the air inlet into the Venturi structure; pressure $P_2$ picked up by a tap $T_2$ leading to the throat 14 in the tertiary Venturi passage; the negative pressure $P_3$ or vacuum picked up by a tap $T_3$ communicating with the intake manifold of the engine.

These three pressure variables are sensed by a vacuum amplifier 30 having a pressure chamber 31 defined in the front section of the relay casing by a diaphragm-mounted piston 32, the diaphragm 32A being relatively large. Piston 32 is deflected to an extent determined by the difference in pressure between pressure $P_1$ at the inlet tap $T_1$ coupled to pressure chamber 31 by line $L_1$ and pressure $P_2$ at the throat tap $T_2$ coupled to pressure chamber 31 by line $L_2$, this pressure differential being applied to one face of the diaphragm whose other face is exposed to atmospheric pressure through filtered vent 57. Thus the deflection of the piston is proportional to the Venturi pressure differential below atmospheric. Piston 32 is biased by means of a spring 33 whose tension is adjustable by a set screw 32 to effect zero and sensitivity adjustment of the fluidic system.

Piston 32 is linked by a piston tube 58 disposed in an intermediate section of the chamber to a valve cap 35 mounted on a small diaphragm 35A which defines a high vacuum chamber 36 in the rear section of the relay casing. The intermediate chamber is vented to the atmosphere, thereby isolating the low vacuum ($P_1-P_2$) chamber 31 from the high vacuum chamber 36. A spring 37 biases cap 35 at the end of an input tube 38 coupled by line $L_3$ to intake manifold tap $T_3$ to supply thereto vacuum $P_3$.

When valve cap 35 is pressed against the end of input tube 38, there is zero vacuum in vacuum chamber 36. In operation, the degree of vacuum in vacuum chamber 36 is determined by deflection of piston diaphragm 32A, which deflection depends on the value differential pressure below atmosphere in pressure chamber 31. The greater the deflection, the further is valve cap 35 urged away from the end of tube 38, this action being counteracted by the diaphragm in the vacuum chamber which seeks to close the valve, thereby counterpoising the air flow vacuum signal ($P_1-P_2$) acting on diaphragm 32.

Thus vacuum chamber 36 supplied with vacuum $P_3$ by the engine intake manifold yields on line $L_4$ coupled thereto an amplified vacuum $P_4$ that is proportional to and is a function of the Venturi differential pressure $P_1-P_2$ multiplied by the ratio of the area of diaphragm 32 to the area of diaphragm 35A, the maximum value of amplified signal being limited by the instantaneous value of the manifold vacuum $P_3$.

The vacuum $P_4$ yield by the vacuum amplifier acts to energize vacuum motor 17 which includes a diaphragm-mounted piston 39 that defines a vacuum chamber 40 in the motor casing. The piston, which is adjustably biased by a spring 41, is coupled to a piston rod 42 operatively linked to pin 18 to linearly control the axial position of Venturi spool 16. In practice, the vacuum motor piston rod may be adjustably spring-biased to counterpose the action of the diaphragm-spring 41, whereby the sensitivity of the motor may be set to a desired point so that the motor responds only when the vacuum signal goes above a predetermined level.

Thus the control system is a closed loop responsive to the significant variables, one being the velocity of air passing through throat 14 of the Venturi, and the other the intake manifold vacuum, the manifold pressure also constituting the sole power source for energizing the system.

The closed loop serves to adjust the size of the throat in secondary passage 16A defined by booster 15 and the Venturi-shaped interior of spool 10, thereby to vary the air velocity through the Venturi structure until a point is reached when the amplified air velocity signal acting on the piston 39 of the vacuum servo-motor 17 achieves null balance with the opposing spring force 41. As a consequence, any throttle change of air flow or engine load change of air flow will immediately alter the air velocity signal ($P_1-P_2$) and the fluidic closed-loop servo system will quickly respond to move the Venturi spool accordingly.

It is important to bear in mind the system characteristic of air-flow vs. Venturi throat velocity is determined by the multiplication factor of vacuum amplifier 30 and the forcecompression characteristic of spring 41 in motor 17. Since these characteristics also control the rate of fuel flow, by design choice any fuel-air ratio may be held constant or varied with engine requirements.

In practice, the vacuum amplifying factor and the servomotor force displacement characteristic are so chosen that maximum opening of the Venturi by the servomotor requires a magnitude of intake manifold vacuum prevailing at medium power requirements. Thus at hard acceleration and high load conditions the manifold vacuum falls below this value and the Venturi automatically closes to enrich the mixture accordingly.

In this manner, load modulation of the loop is accomplished without requiring electric or other transducers for this purpose.

In those applications where it is desirable to hold air-fuel ratios more closely to the stoichiometric, optionally associated with the fluidic control system is an air-fuel mixture Lambda sensor 43 which is placed in the exhaust 44 of the engine to generate a voltage whose magnitude depends on whether the ratio is below or above stoichiometric. The voltage of sensor 43 is applied to an electronic module 45 which processes this information to provide a first output signal $S_1$ which reflects the degree to which the mixture is unduly rich, and a second output voltage $S_2$ which reflects the degree to which the mixture is unduly lean relative to stoichiometric.

Signal $S_1$ is applied to a normally-open solenoidoperated valve 46 in line $L_1$ leading from the Venturi inlet into vacuum signal chamber 31 of vacuum amplifier 30 through an orifice restriction 47. When the deviation reflects undue richness, signal $S_1$ acts to close valve 46 to an extent leaning the mixture to restore the stoichiometric ratio.

Signal $S_2$ from module 45 is applied to a normally-closed valve 48 placed in a by-pass line between Venturi inlet line $L_1$ and vacuum signal chamber 31 of the vacuum amplifier and serves, when the deviation reflects undue leanness, to open this valve to bleed the chamber to an extent enriching the mixture to restore the stoichiometric ratio. Restriction 47 serves for midrange adjustment. Thus the air-fuel mixture sensor electronic system acts to vary the sensitivity of the closed-loop fluidic control system, this feature being useful in special situations as, for instance, long-haul trucks which travel through regions having widely varying temperature and atmospheric conditions.

Second Embodiment

In this embodiment as shown in FIG. 2, the Venturi structure is essentially the same as in FIG. 1; but in this instance a fuel pressure feed is employed in which fuel from a tank 49 is pumped by pump 56 through a pressure-regulated flow control valve 50 into a fuel jet tube 54 coaxially disposed in an air chamber 51. This chamber communicates through a duct 52 to the air inlet of the Venturi structure, which duct acts as an air induction tube to produce a fuel spray or dispersion and idle speed adjustment.

Chamber 51 has an aperture which feeds the resultant air-fuel spray into nozzle 26B seated within booster 15B of the Venturi structure. Thus the fuel dispersion is drawn into the Venturi primary passage as a result of both induction and pressure forces. Duct 50 is provided with an idle by-pass screw 53 around throttle 56.

In this arrangement, the fluidic control system is essentially identical to that in FIG. 1, the system including vacuum motor 17 for adjusting the axial position of the Venturi spool and a vacuum amplifier which yields the vacuum signal $P_4$ for operating the motor and is responsive to variables $P_1$, $P_2$ and $P_3$.

However, in this arrangement, vacuum signal $P_4$ from the amplifier is also applied to the fuel regulatory valve 50 to modulate fuel pressure in direct proportion to the magnitude of the vacuum signal. In this arrangement, the air intake may be an atmospheric air supply or a supercharged atmosphere obtained from known air blower arrangements for this purpose. Priming of the fuel regulating valve 50 may be time-controlled by a priming signal source 59 yielding a priming signal $S_3$.

Thus all of the interacting and interrelated variables involved in the behavior of the internal combustion engine are taken into account, the sensed variables acting on the automatic control system to automatically regulate the ratio of air-to-fuel throughout the full spectrum of prevailing conditions of speed and load encountered under both ordinary and extraordinary conditions to optimize combustion efficiency.

While there have been shown and described preferred embodiments of a fuel-air ratio automatic control system using variable Venturi structure in accordance with the invention, it will be appreciated that many changes and modifications may be made therein without, however, departing from the essential spirit thereof.

I claim:

1. A closed-loop fluidic control system for an internal combustion engine having a variable Venturi carburetor whose inlet is coupled to a source of combustion air, fuel being fed into the carburetor to intermingle with the air passing therethrough to produce an air-fuel mixture which is fed into the intake manifold of the engine, said Venturi including an axially-shiftable spool whose position affects flow velocity through the Venturi, said system automatically adjusting the axial position of the spool to produce a ratio of fuel-to-air that is optimum for prevailing conditions of engine speed and load, said system comprising:

A. a vacuum amplifier coupled to the intake manifold and responsive to the existing pressure differential between the inlet and throat of the Venturi to derive from the prevailing vacuum in the manifold vacuum an amplified output vacuum which is a function of said pressure differential; and B. a bi-directional vacuum motor energized by said amplified output vacuum and operatively linked to the spool to vary the axial position thereof in a direction and to an extent providing the desired fuel-to-air ratio.

2. A system as set forth in claim 1, wherein said amplifier includes a large diaphragm supported in a casing to define a low pressure chamber coupled to said inlet and throat to cause deflection of the large diaphragm in accordance with said differential pressure, said amplifier further including a vacuum chamber coupled to the intake manifold, and means to derive an amplified vacuum output from said vacuum chamber whose magnitude depends on the magnitude of the differential pressure acting on the large diaphragm, said output vacuum actuating said vacuum motor accordingly.

3. A system as set forth in claim 2, wherein said vacuum chamber is defined by a small diaphragm supporting a valve cap that is linked to the large differential-pressure diaphragm, the valve cap cooperating with the end of an input tube coupled to said intake manifold to open and close said tube in accordance with the deflection of the large diaphragm until force balance is obtained with the output vacuum force imposed on the small diaphragm.

4. A system as set forth in claim 3, wherein the differential pressure diaphragm is spring-biased.

5. A system as set forth in claim 4, further including means to adjust said bias to vary the sensitivity of the amplifier.

6. A system as set forth in claim 5, further including means to spring-bias the valve cap supported on the small diaphragm.

7. A system as set forth in claim 1, wherein said vacuum motor includes a diaphragm-supported piston defining a vacuum chamber to which said vacuum signal is supplied, and a piston rod attached to said piston and operatively linked to the Venturi spool.

8. A system as set forth in claim 1, wherein said Venturi includes concentric passages within a casing constituted by a primary Venturi passage formed by a nozzle Venturi and a booster and leading to a secondary Venturi passage defined by said axially shiftable spool, and a tertiary Venturi passage between said casing and said spool, said inlet supplying air to all three passages, said fuel being introduced into said nozzle.

9. A system as set forth in claim 8, wherein said fuel is drawn from a chamber having a vertical fuel tube therein whose end is provided with a jet opening, the upper end of the tube being coupled by a duct to a nozzle disposed in said booster and having openings therein which spray the fuel into the booster.

10. A system as set forth in claim 1, wherein said fuel is injected into said Venturi booster under pressure through a vacuum fuel regulator which is operated by said output vacuum to vary the fuel pressure as a function of intake manifold vacuum.

11. A system as set forth in claim 1, further including a fuel-air ratio sensor in the exhaust of the engine to produce a voltage which depends on the ratio, and an electronic module for processing said sensor voltage to produce control signals which are applied to said fluidic system to effect correction thereof for deviations in the ratio from stoichiometric.

12. A system as set forth in claim 11, wherein said control signals include a first signal which operates a valve in the line between the Venturi inlet and the pressure chamber of the relay to adjust the pressure therein to lean the mixture, and a second signal which operates a bleed valve coupled to the pressure chamber to adjust the pressure therein to enrich the mixture.

13. A system as set forth in claim 12, wherein said sensor is a platinum-coated zirconium element.

14. A system as set forth in claim 1, wherein said engine includes a controllable throttle interposed between the Venturi carburetor and the intake manifold.

15. A system as set forth in claim 1, wherein said engine includes a controllable throttle interposed between the inlet to the Venturi carburetor and the source of combustion air.

* * * * *